US005405506A

United States Patent [19]

Kumpulainen

[11] Patent Number: 5,405,506

[45] **Date of Patent: * Apr. 11, 1995**

[54] APPARATUS AND METHOD FOR FEEDING RAW MATERIAL INTO AN ALUMINUM PRODUCING ELECTROLYSIS

[75] Inventor: Vesa Kumpulainen, Espoo, Finland

[73] Assignee: Kumera Oy, Riihimaki, Finland

[ * ] Notice: The portion of the term of this patent subsequent to Jan. 3, 2012 has been disclaimed.

[21] Appl. No.: 75,025

[22] Filed: Jun. 11, 1993

[51] Int. Cl.[6] ..... C25C 3/06; C25C 3/14

[52] U.S. Cl. ..... 204/67; 204/245

[58] Field of Search ..... 204/67, 243, 245

[56] References Cited

U.S. PATENT DOCUMENTS

| | | | |
|---|---|---|---|
| 2,713,024 | 5/1951 | Mantovanello | 204/67 |
| 4,049,529 | 9/1977 | Golla | 204/245 |
| 5,030,335 | 7/1991 | Olsen | 204/243 R |

FOREIGN PATENT DOCUMENTS 126271 4/1960 U.S.S.R. .

*Primary Examiner*—Kathryn Gorgos

*Attorney, Agent, or Firm*—Steinberg, Raskin & Davidson

[57] ABSTRACT

An apparatus and method for feeding powderized raw material, such as aluminum oxide, into an aluminum producing electrolysis reaction, in which the electrolysis is produced by an anode and cathode apparatus and a powderized raw material is conveyed from a silo or equivalent to a feeding apparatus and then into an electrolyte melt. The feeding apparatus has a controlling box for controlling the raw material feeding and a feeding pipe connected thereto. The feeding apparatus has a feeding device arranged to operate within the box and connected through a piston shaft to a vibrator. The vibrator produces a substantially vertical vibration of the feeding device. An open lower end of the controlling box is positioned in the vicinity of the surface of the electrolyte melt so that the controlling box operates within the electrolyte crust.

19 Claims, 3 Drawing Sheets

APPARATUS AND METHOD FOR FEEDING RAW MATERIAL INTO AN ALUMINUM PRODUCING ELECTROLYSIS

BACKGROUND OF THE INVENTION

The present invention relates to an apparatus for feeding powderized raw material, such as aluminum oxide, into an aluminum producing electrolysis comprising an anode and cathode apparatus, and means for transferring powderized raw material from a silo or equivalent to the feeding apparatus. The raw material is fed by means of the feeding apparatus into an electrolyte melt in which electrolysis occurs. Electrolysis is the process of producing a chemical change by the passage of an electric current through an electrolyte, e.g., an electrolyte cell or other non-metallic electric conductor in which current is carried, such that the ions present carry the current by migrating to the electrodes. A method for feeding powderized raw material into an aluminum producing electrolysis reaction is also disclosed.

The invention is classified within an electrolytic production range of aluminum accomplished in an electrolysis reaction with self-baking anodes. However, the present invention can be used in electrolysis reactions provided with baked anodes, and in which the electrolysis cells are fed with aluminum oxide or other equivalent raw materials.

In the prior art, the electrolysis process of the production of aluminum is accomplished as a continuous process. The feeding of the raw material, preferably aluminum oxide, is usually carried out intermittently in the form of batch feeding by penetrating the crust of electrolyte, and in practice, by feeding an uncontrolled portion of aluminum oxide spread prior to transmission of the raw material upon the crust.

In prior art feeding methods utilizing various feeding means, major failures occur in the electrolysis process which can cause instability in the process. This is primarily due to the fact that the concentration of aluminum oxide in the molten electrolyte changes from the maximum value at the charging moment to a minimum value at the starting moment of an anode effect. As a result, the consumption of electrical energy increases, the efficiency of the current decreases and precipitations are formed on the bottom of the electrolysis cell.

Other significant problems related to electrolytic aluminum production include the problem of guaranteeing a reliable and simple continuous feeding of the electrolysis reaction without substantially breaking the electrolyte crust so that a sufficiently uniform aluminum oxide concentration can be maintained in the electrolysis reaction.

Among the prior art techniques, U.S.S.R. Inventor's Certificate No. SU 126,217 describes a method for feeding aluminum oxide into an aluminum producing electrolysis reaction wherein aluminum oxide is fed into the electrolyte using a vibration method. The purpose of this method is to accelerate the dissolution of aluminum oxide in the electrolyte cell and to prevent precipitation thereof on the bottom of the electrolyte cell. According to the SU inventor's certificate, the aluminum oxide travels from a silo through a dispenser along a pipe to a feeding means vibrating with the aid of a vibratory drive means.

In a first alternative embodiment of this prior art device, the feeding means is a spherical pump provided with apertures for discharging the aluminum oxide. By vibrating the feeding means, which has an amplitude directed in a horizontal direction, the purpose of the spherical pump immersed within the electrolytic electrolyte cell is to assist in dissolving the aluminum oxide in the electrolyte. According to a second alternative embodiment, a horizontal plate is attached to a vibrator such that a tip of the plate is immersed within the electrolyte. When subjected to the vibration forces, the aluminum oxide passes from the plate into the electrolyte cell in order to intensify the dissolution process of aluminum oxide.

This prior art process is not used conventionally in view of the fact that there are difficulties associated with maintaining the surface of the molten electrolyte cell open at the aluminum oxide feeding point. This is because the crust is produced rapidly on the surface of the molten electrolyte when cold aluminum oxide enters into contact with the electrolyte. Additional difficulties are caused by the fact that there are no materials which are capable of resisting the cryolite-aluminum oxide melt.

U.S. Pat. No. 2,713,024 describes a prior art method for the continuous feeding of an aluminum producing electrolysis reaction wherein a pipe is placed under a feeding means positioned on the surface of the electrolyte melt. Aluminum oxide is fed into the pipe and conveyed to an aluminum oxide column produced in the melt at the inlet area with pressure being provided by the feeding means. The feeding means which provide the pressure are not in contact with the aluminum oxide column being directed into the melt. The process according to this prior art device is, independent on the electrolysis, accomplished with feeding means including a silo, below which is located a dispenser unit of screw type and a conveying pipe connecting the dispenser with the feeding means. In the feeding means, diverse screw, piston or crank lever mechanisms are used which change the rotary motion of the flywheel into an advancing circulatory motion and which have been mounted on the feeding pipe on the surface of the electrolyte melt, and connected with electrically operating means.

The device of U.S. Pat. No. 2,713,024 requires the use of a means with which aluminum oxide is carried into the melt with the aid of the energy of pressurized air. The feeders of the aluminum oxide can be mounted, depending on the type of electrolysis, on the side of, inside of or in the middle of the anodes. In spite of the advantages of the process described in this prior art device, it has not come into a wider use because a significant drawback of this device is that when the raw material is introduced into the molten electrolyte through the electrolyte crust, difficulties have arisen in overcoming the large forces produced therein.

OBJECTS AND SUMMARY OF THE INVENTION

It is an object of the present invention to further develop the state of art technique in electrolysis reactions described above so that drawbacks present in the prior art devices are substantially eliminated.

It is another object of the present invention to provide a new and improved apparatus and method for feeding raw material into an aluminum producing electrolysis reaction in which the energy costs related to feeding loose raw material into the melt are reduced.

It is yet another object of the present invention to provide a new and improved apparatus and method for feeding raw material into an aluminum producing electrolysis reaction in which the reliability of operation of the actuating means is increased.

It is still another object of the present invention to intensify the burning of anode gases in an improved apparatus and method for feeding raw material into an aluminum producing electrolysis reaction.

For attaining the above objects, and others, the feeding apparatus in accordance with the invention comprises a box for controlling the feeding of raw material and a feeding pipe connected to the controlling box and through which the raw material is conveyed into an electrolyte melt. The feeding apparatus also comprises a feeding means arranged within the controlling box. The feeding means are arranged to be active and connected with a piston shaft or equivalent to a vibrator which produces vibrations in the feeding means, primarily in a vertical direction. An open lower end of the controlling box is positioned in proximity to the surface of the electrolyte melt, i.e., immediately above the surface of the melt, in order to act on the electrolyte crust.

In a preferred embodiment of the invention, the vertically vibrating vibrator is further provided with means which move and displace it in a vertical direction relative to the molten surface of the electrolyte melt. These movements maintain unobstructed the opening in the electrolyte crust through which the raw material is passed.

In another preferred embodiment of the invention, a pneumatic vibrator is used as a feed drive means. A discharge connector of the used air of the feed drive means is connected to an anode gas combustion apparatus by means of a gas conduit attached to a wall of the anode box.

In yet another preferred embodiment of the invention, the lower end of the feed pipe acts as a controlling box fitted in the anode gas discharge apparatus.

In comparison with a traditional raw material feeding process, the consumption of electrical energy in an apparatus in accordance with the present invention can be substantially reduced and the efficiency of the current can be increased because the anode effect can be substantially diminished. In addition, when feeding raw material hermetically, the thermo-balance of the electrolysis reaction improves. Moreover, the consumption of an additive needed in order to improve the composition of the electrolyte and the costs related to the personnel work can be reduced.

In the method in accordance with the invention, a raw material is conveyed from storage means to a feeding apparatus and passed through the feeding apparatus into an electrolyte melt in which electrolysis occurs. A controlling box is arranged in the feeding apparatus to control the feeding of raw material into the electrolyte melt. An open lower end of the controlling box is positioned above and adjacent to a crust of the electrolyte melt. The feeding means are vibrated in a substantially vertical direction by connecting a vibrator to the feeding means through a piston shaft. The vibration of the feeding means causes the raw material to penetrate the crust of the electrolyte melt and form an opening therein through which the raw material passes into the electrolyte melt.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
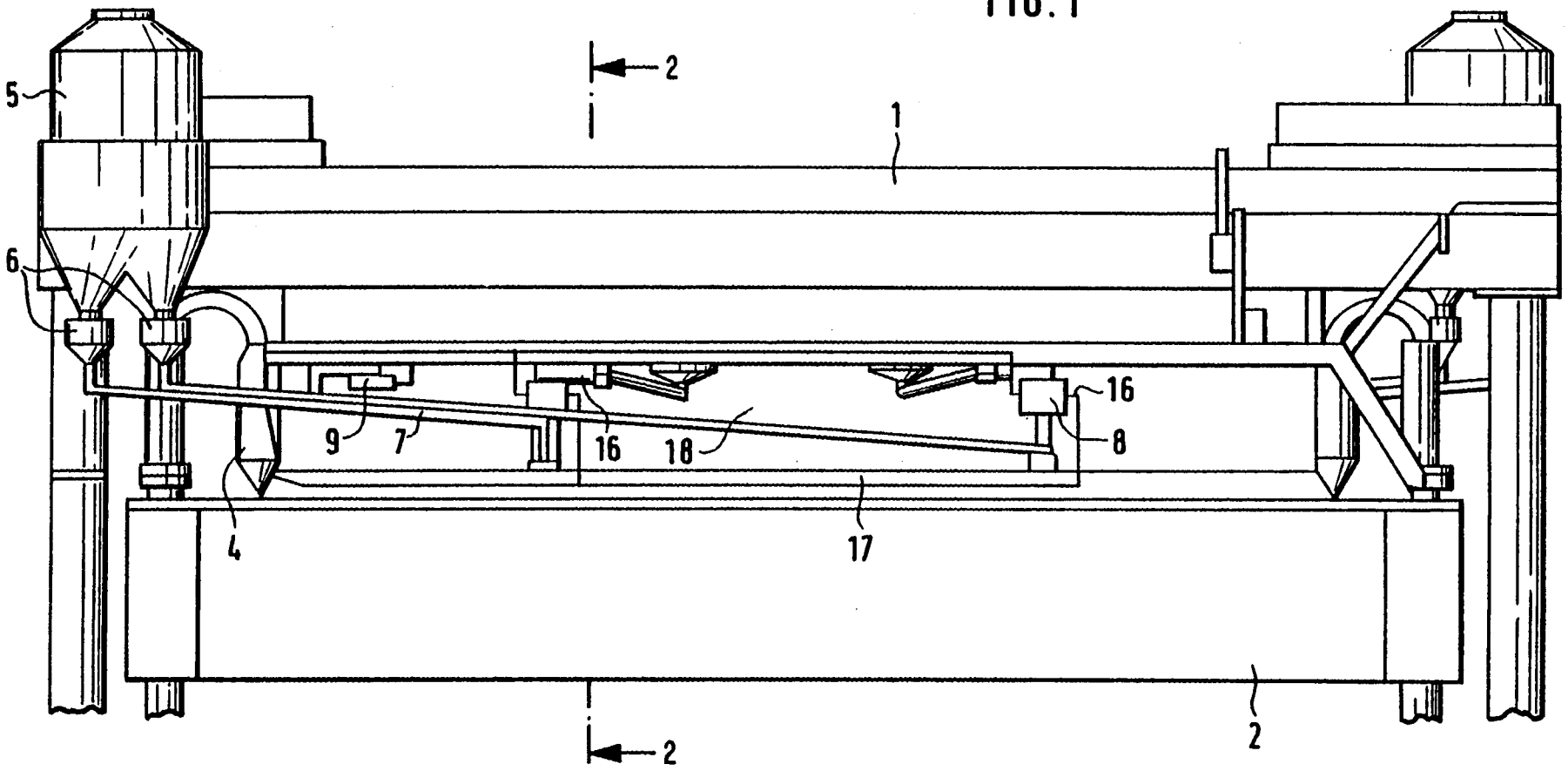
FIG. 1 illustrates an elevational view of an electrolyte melt in accordance with the present invention.
Figure 2A:
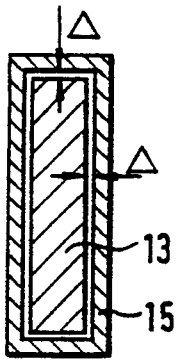
FIG. 2A shows a horizontal section 2A—2A of the embodiment of the present invention shown in FIG. 2.
Figure 2:
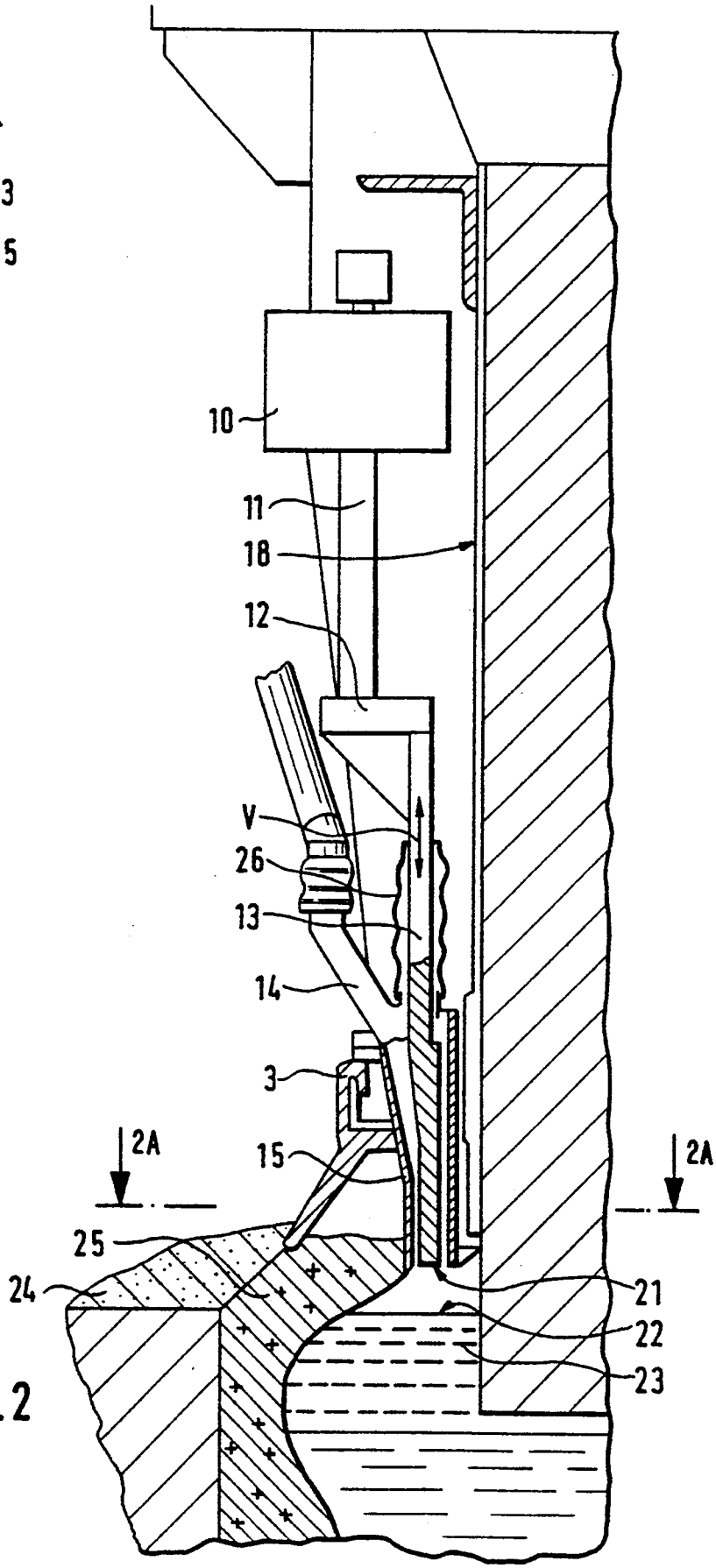
FIG. 2 shows a vertical section 2—2 of the embodiment of the present invention shown in FIG. 1.
Figure 3:
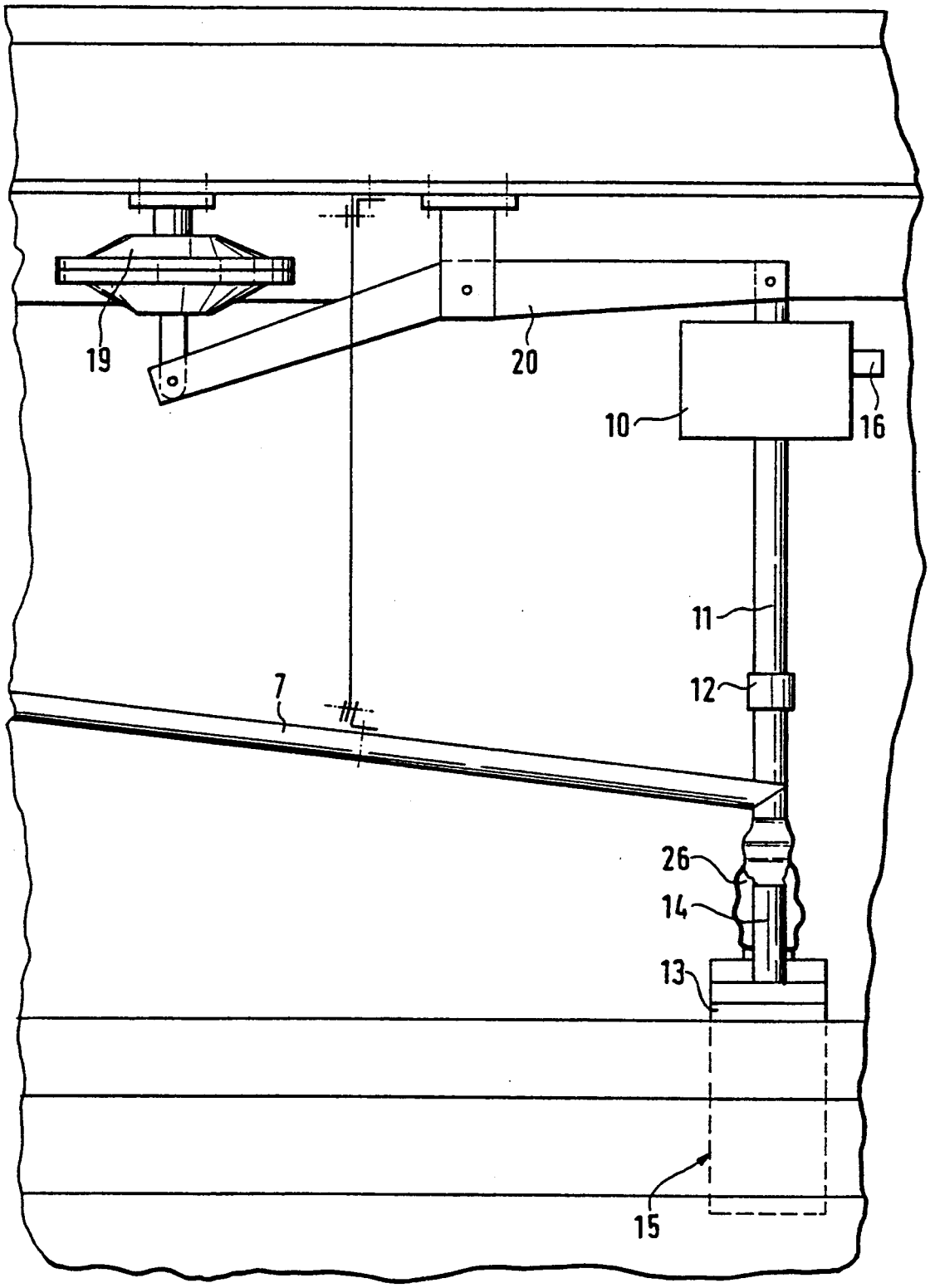
FIG. 3 illustrates the process of feeding raw material into the melt and a vertical transfer system of the feeding means in accordance with the present invention.

Referring to FIGS. 1–3, in the present invention, the apparatus for producing aluminum in an electrolysis reaction comprises an anode apparatus 1, a cathode apparatus 2, recovery means 3 of anode gases, an anode gas combustion means 4, and a silo 5 for the storage of the powderized raw material. Dispensers 6 are placed under the silo 5 and are connected by conveying means, such as a material lead 7, to a raw material feeding means 8. The material lead 7, or other conveying means, is intended for conveying raw material and is provided with a longitudinal vibrator 9.

The feeding means of the powderized raw material comprise a vibrator 10, which produces a vertical vibration V, or other suitable drive means. The vibrator 10 is connected to a piston shaft 11. The piston shaft 11 is connected to feeding means 13 tightly fitted in a feed pipe 14 by means of a clamping element 12. The lower part of the feeding pipe 14 acts as a box 15 controlling the feeding of the raw material into the electrolyte melt.

A shaft is attached to the upper end of the feeding means 13 and is passed through an upper wall of the box 15 controlling the feeding. The inlet area where the shaft passes through the wall is sealed with elastic bellows 26 or equivalent sealing means.

Referring to FIG. 2A, the lower end of the box 15 controlling the feeding is preferably rectangular in a horizontal cross-section. The lower end of the feeding means 13 is also preferably rectangular in an equivalent horizontal section, i.e., it is arranged to fit within the horizontal shape of the controlling box 15. Between the inner surface of the box 15 and the outer surface of the feeding means 13, there is an appropriate small clearance $\Delta$ in the vicinity of the lower end of the feeding means 13. This small clearance $\Delta$ has a magnitude of between about 5 mm and about 15 mm, most preferably from about 7 mm to about 10 mm. Raw material is conveyed through this clearance $\Delta$ between the inner surface of the box 15 and outer surface of the feeding means 13. The raw material flows, with the assistance of the vibration of the feeding means 13, through an opening 21 in a crust 25 into an electrolyte melt 23.

In this regard, it should be noted that the particular cross-sectional shape of the interior of the controlling box 15 and the exterior of the feeding means 13 may be any shape, e.g., rectangular, circular, etc. However, the shape of the feeding means 13 should correspond to the shape of the controlling box 15 such that the feeding means 13 fit into the controlling box 15 with a specific clearance $\Delta$.

When using a pneumatic vibrator 10 as the drive means in the feeding process of powderized raw material, the vibrator is provided with a pressurized air feeding and discharging system. A pipe connector 16 of the used air is connected to a gas conduit 17 which leads into the anode gas combustion means 4. The gas conduit is attached on the wall of an anode box 18 in order to heating the air.

Movement means 19 is arranged to provide the vertical movement of the vibrator 10, and at the same time, to move the feeding means 13, e.g., pneumatic diaphragm actuator, which by a lever system 20 has been attached to the vibrator 10.

The aluminum producing electrolysis reaction described above operates as follows. Powderized raw material, such as aluminum oxide, is transferred from the silo 5 to the dispenser 6. From the dispenser 6, the raw material is conducted through the hermetical material lead 7 to the feed pipe 14 with the aid of the vibration forces produced by the vibrator 9. With the aid of the vibrator 10, the piston shaft 11, together with the feeding means 13 attached thereto, is arranged to provide a reciprocating vertical vibratory motion V. Due to the vibration V, the raw material passes from the feed pipe 14 into the box 15 controlling the raw material feeding, in which it gradually becomes warmer while moving in a downward direction toward the electrolyte melt.

Since the raw material is fed into the electrolysis reaction continuously in small portions, it is heated to a temperature in a range of about 300° C. to about 400° C. In this manner, more advantageous conditions are created for improving the dissolution of the raw material in the electrolyte and for minimizing formation of the crust 25. The heating required to heat the raw material may be applied either internally or externally.

While moving in the downward direction, the raw material enters under the feeding means 13 and starts to accumulate there. When a column of the raw material, e.g., aluminum oxide, thus produced touches the feeding means 13, the active action of the vibrating feeding means on the aluminum column starts so that a penetration force is transmitted to the crust 25 of the electrolyte. In this manner, the crust is penetrated and permits the aluminum oxide to enter the electrolyte melt. In other words, at a point where raw material is passed into the melt, the raw material itself functions as a tool for penetrating through the continuously forming crust 25.

At a spot where aluminum oxide is supplied into the melt 23, and in the vicinity thereof, the electrolyte crust 25 is continuously being formed, and accumulating into a thickness which is considerable, particularly in proximity to the raw material inlet opening 21. This is caused by the fact that when starting to feed aluminum oxide into the electrolyte, the electrolyte crust 25 forms first, in which the thickness grows in the course of the continued feeding of cold aluminum oxide to a given extent such that an aluminum oxide layer 24 accumulates on the crust. When the aluminum oxide column touches the feeding means 13, its active influence begins to have an effect on the column which serves to transmit the penetration force to the crust 25 of the electrolyte. Under the influence of this penetration force, the crust 25 within the operation zone of the feeding means 13 depresses, and the opening 21 is formed from which aluminum oxide will thereafter be fed into the electrolyte melt.

The strength and thickness of the crust 25 around the opening 21 is significant, and therefore, when the aluminum oxide column is pressed through the opening 21, large friction forces are generated which must be overcome by the feeding means 13.

In order to take the raw material into the melt 23 without disturbances and to make the feeding means operate more reliably, the movement means 19 move in the vertical direction at set time intervals which preferably are in the range of about 30 minutes to about 60 minute. Also, the movement means 19 transfer, through the lever system 20, the vertical vibration vibrator 10 downwards by about 150 to about 2090 mm. As a result of the simultaneous effect of the vibration, the feeding means 13 also move an equal distance in a downward direction until it touches the surface 22 of the melt 23. The entire system is then returned to the initial situation and position, and the normal operation described above continues. As a preventive measure, the additional movements of the feeding means 13 cleanse the opening 21 of the electrolyte crust 25.

When using the pneumatic vibrator 10, the pulsating air used therein is initially heated with the heat generated in the wall of the anode box 18 and is then conducted via the connector 16 and the gas conduit 17 to the anode gas combustion means 4. The pulsating compressed air increases the combustion efficiency of resins and 'cancerogenic' agents and decreases the pollution of air.

In the present invention, there is wear of the feeding means 13 when the lower end of the feeding means 13 is continuously subjected to vibration and in contact with the aluminum oxide. In order to compensate for the wearing effect and to maintain the lower end of the feeding means 13 at a given level above the surface 22 of the melt 23, the feeding means 13 can, when being maintained, be reused by cutting off the worn part and by welding a new part on the lower end, or the feeding means 13 can be totally replaced. It may be desirable and easy to release the clamping element 12 to thereby release the feeding means 13 when replacing the feeding means.

An apparatus in accordance with the present invention was tested in industrial conditions which fed aluminum oxide into the melt with the aid of vibration of the feeding means 13. The vibration being directed to the feeding means 13 at given amplitudes and frequencies considerably reduced the friction forces of the aluminum oxide column in the walls of the opening 21 in the electrolyte, and simultaneously reduced energy consumption when passing the aluminum oxide into the melt 23. Because of a more reliable feeding of the raw material into the melt 23 and better removal of anode gases from the electrolyte crust 25, the vibrating feeding means 13 was immersed from time to time into the electrolyte melt 23. The feeding means 13 was removed from the melt 23 by connecting the vertical vibration vibrator 10 to the vertical transfer and movement means 19 moving relative to the melt 23.

In addition, the design of the electrolyte melt in accordance with the present invention allows the opening 21 of the electrolyte crust 25 to be kept clean by impeding growth of the crust 25.

The vibrator 10 can operate by means of compressed air. In such an embodiment, after the compressed air had released the energy feeding means 13 into vibration forces V, the pulsating compressed air, having initially been heated by the anode, was recovered and conducted into the anode gas combustion means in which a large oxygen deficiency was found to prevail. As a result of the pulsation of the air current, the combustion temperature of the anode gases increased, enabling a more efficient burning of resin and breaking up, and burning of 'cancerogenic' agents into simple basic elements.

It is important to note that although the embodiment of the present invention includes a vibrator arranged to vibrate the feeding means in a vertical direction, it is possible that the feeding means can be vibrated or agitated by other means and/or in other directions, i.e., a horizontal direction.

The examples provided above are not meant to be exclusive. Many other variations of the present invention would be obvious to those skilled in the art, and are contemplated to be within the scope of the appended claims.

I claim:

1. In an apparatus for feeding raw material into an aluminum producing electrolysis reaction, comprising an anode and cathode apparatus, a feeding apparatus for feeding a raw material into an electrolyte melt in which an electrolysis reaction is produced by said anode and cathode apparatus, conveying means for conveying the raw material to said feeding apparatus, the improvement comprising said feeding apparatus comprising a raw material feed pipe connected to said conveying means, a controlling box for controlling the feeding of raw material into the electrolysis reaction, said controlling box having an open lower end positioned above and adjacent to a crust of the electrolyte melt, the raw material is conveyed from said conveying means through said raw material feed pipe to said controlling box, feeding means arranged within said controlling box for feeding the raw material to a space between said feeding means and the crust of the electrolyte melt, and vibrator means for vibrating said feeding means, such that upon sufficient accumulation of raw material in said space supported on the crust of said electrolyte melt, said feeding means are vibrated by said vibrator means to contact the accumulated raw material in said space and urge the raw material through the crust of and into the electrolyte melt.

2. The apparatus of claim 1, further comprising storage means for storing the raw material, said storage means are connected to said conveying means such that the raw material is conveyed from said storage means through said conveying means to said controlling box.

3. The apparatus of claim 1, wherein said vibrator means is arranged to produce a substantially vertical vibration of said feeding means.

4. The apparatus of claim 1, further comprising sealing means to seal an inlet area where said piston shaft passes through an upper wall of said controlling box.

5. The apparatus of claim 4, wherein said sealing means comprise elastic bellows.

6. The apparatus of claim 1, further comprising vertical transfer means for moving said feeding means in a vertical direction relative to the crust of the electrolyte melt.

7. The apparatus of claim 6, wherein said vertical transfer means are connected to said feeding means and said vibrator means, said vertical transfer means are arranged such that a lower end of said feeding means is intermittently conveyed to the vicinity of the crust of the electrolyte melt.

8. The apparatus of claim 6, wherein said vertical transfer means comprises a pneumatic diaphragm actuator and a lever system attached to said vibrator means.

9. The apparatus of claim 1, wherein a horizontal section at a lower end of said controlling box has a rectangular cross-section, and a lower end of said feeding means arranged within said lower end of said controlling box has a corresponding horizontal cross-section such that a clearance is defined between an inner surface of said controlling box and an outer surface of said feeding means, the clearance is in a range of about 5 mm to about 15 mm.

10. The apparatus of claim 9, wherein the clearance between said inner surface of said controlling box and said outer surface of said feeding means is in a range of about 7 mm to about 10 mm.

11. The apparatus of claim 1, wherein said vibrator means comprises a pneumatic vibrator which produces a substantially vertical vibration of said feeding means, the apparatus further comprising an anode gas combustion apparatus and a gas conduit connected to said anode gas combustion apparatus, said pneumatic vibrator having an outlet of discharge air passed to said gas conduit.

12. The apparatus of claim 11, wherein said gas conduit is attached to a wall of said anode apparatus to heat exhaust air from said pneumatic vibrator.

13. The apparatus of claim 1, further comprising anode gas recovery means and connecting means to connect an interior of said controlling box to said anode gas recovery means.

14. The apparatus of claim 1, wherein said controlling box is positioned to operate within an electrolyte crust of the electrolysis.

15. The apparatus of claim 1, further comprising an additional vibrator connected to said conveying means such that the raw material flows through said conveying means by means of vibrations produced by said additional vibrator.

16. The apparatus of claim 1, further comprising a piston shaft for connecting said feeding means to said vibrator.

17. A method for feeding raw material into an aluminum producing electrolysis reaction, comprising conveying a raw material from storage means to a feeding apparatus, feeding a raw material through the feeding apparatus into a space defined between said feeding apparatus and a crust of an electrolyte melt in which electrolysis occurs, arranging a controlling box in the feeding apparatus to control the feeding of raw material into the electrolysis reaction, positioning an open lower end of said controlling box above and adjacent to a crust of the electrolyte melt to define said space, and vibrating said feeding means in a substantially vertical direction by connecting vibrator means to said feeding means, such that upon sufficient accumulation of raw material in said space supported on the crust of said electrolyte melt, said feeding means are vibrated by said vibrator means to contact the accumulated raw material in said space and urge the raw material to penetrate the crust of the electrolyte melt and form an opening therein through which the raw material passes into the electrolyte melt.

18. The method of claim 17, further comprising moving said feeding means in a vertical direction relative to the crust of the electrolyte melt such that a lower end of said feeding means is intermittently moved to the vicinity of the crust of the electrolyte melt or under the crust of the electrolyte melt.

19. The method of claim 17, further comprising providing a clearance between an inner surface of a horizontal section at a lower end of said controlling box and an outer surface at a lower end of said feeding means arranged within said lower end of said controlling, said clearance is in a range of about 5 mm to about 15 mm.

* * * * *